US009829259B2

(12) United States Patent
Nyander et al.

(10) Patent No.: US 9,829,259 B2
(45) Date of Patent: Nov. 28, 2017

(54) HEAT EXCHANGER PLATE AND A PLATE HEAT EXCHANGER

(71) Applicant: ALFA LAVAL CORPORATE AB, Lund (SE)

(72) Inventors: Anders Nyander, Staffanstorp (SE); Klas Bertilsson, Eslöv (SE); Nils Bjelk, Landskrona (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/395,304

(22) PCT Filed: Mar. 11, 2013

(86) PCT No.: PCT/EP2013/054904
§ 371 (c)(1),
(2) Date: Oct. 17, 2014

(87) PCT Pub. No.: WO2013/156207
PCT Pub. Date: Oct. 24, 2013

(65) Prior Publication Data

US 2015/0114594 A1 Apr. 30, 2015

(30) Foreign Application Priority Data

Apr. 20, 2012 (EP) ..... 12164949

(51) Int. Cl.
*F28F 27/00* (2006.01)
*F28F 3/08* (2006.01)
(Continued)

(52) U.S. Cl.
CPC ..... *F28F 27/00* (2013.01); *F28D 9/005* (2013.01); *F28F 3/00* (2013.01); *F28F 3/08* (2013.01)

(58) Field of Classification Search
CPC .... F24F 11/001; F24F 11/0009; F24F 11/022; F24F 11/02; F24F 2011/0043;
(Continued)

(56) References Cited

U.S. PATENT DOCUMENTS 5,121,929 A 6/1992 Cobb
5,255,977 A * 10/1993 Eimer ..... G01K 17/08 165/11.1
(Continued)

FOREIGN PATENT DOCUMENTS

CN 1813164 A 8/2006
CN 1965221 A 5/2007
(Continued)

OTHER PUBLICATIONS

Notification Concerning Transmittal of International Preliminary Report on Patentability (Forms PCT/IB/326 and PCT/IB/373) and the Written Opinion of the International Searching Authority (Form PCT/ISA/237) dated Oct. 30, 2014, by the International Bureau of WIPO in corresponding International Application No. PCT/EP2013/054904. (6 pages).
(Continued)

*Primary Examiner* — Grant Moubry
*Assistant Examiner* — For K Ling
(74) *Attorney, Agent, or Firm* — Buchanan Ingersoll & Rooney PC

(57) ABSTRACT

The invention refers to a heat exchanger plate and a plate heat exchanger. The heat exchanger plates are arranged beside each other in the plate heat exchanger to define several first plate interspaces for a first medium and several second plate interspaces for a second medium. Each heat exchanger plate comprises a heat transfer area, an edge area, which extends around and outside the heat transfer area, and a functional device, which is configured to receive or
(Continued)

produce a signal. The heat exchanger plate also comprises a communication module provided on the heat exchanger plate. The communication module comprises an electronic circuit connected to the functional device and a module antenna. The communication module is configured to permit wireless communication of the signal with a master unit via the module antenna.

14 Claims, 3 Drawing Sheets

(51) Int. Cl.
*F28D 9/00* (2006.01)
*F28F 3/00* (2006.01)

(58) Field of Classification Search
CPC ..... F24F 2011/0045; F24F 2011/0071; F24F 2011/0075; F28F 3/08; F28F 27/00; F28F 27/02; F28F 2265/00; F28F 2265/12; F28F 2265/16; F28F 2265/18; F28F 2265/20; F28D 9/005
USPC ..... 165/11.1, 11.2, 165–167
See application file for complete search history.

(56) References Cited

U.S. PATENT DOCUMENTS

| | | | | |
|---|---|---|---|---|
| 7,152,663 | B2 * | 12/2006 | Helin | F28D 9/005 165/11.1 |
| 7,319,393 | B2 * | 1/2008 | Forster | G06K 7/0008 340/10.3 |
| 7,568,516 | B2 * | 8/2009 | Bergqvist | F16J 15/064 165/11.1 |
| 8,505,619 | B2 * | 8/2013 | Persson | F24D 19/1051 165/164 |
| 8,591,102 | B2 | 11/2013 | Frach et al. | |
| 8,899,312 | B2 * | 12/2014 | Bader | F28D 9/005 165/103 |
| 8,985,192 | B2 * | 3/2015 | Mitsuhashi | F28D 9/0062 165/11.1 |
| 2006/0237548 | A1 * | 10/2006 | Hartney | F28D 9/00 236/1 C |
| 2007/0084237 | A1 * | 4/2007 | Stromblad | F25B 39/022 62/513 |
| 2007/0125527 | A1 * | 6/2007 | Flik | F02B 29/0412 165/140 |
| 2008/0164006 | A1 * | 7/2008 | Karamanos | F24F 1/0059 165/67 |
| 2009/0102614 | A1 | 4/2009 | Koyama et al. | |
| 2012/0024504 | A1 * | 2/2012 | Jensen | F24D 3/10 165/121 |
| 2012/0048768 | A1 * | 3/2012 | Holloway | C09K 5/063 206/524.1 |
| 2013/0233508 | A1 * | 9/2013 | Cederberg | F28F 3/083 165/11.1 |

FOREIGN PATENT DOCUMENTS

| | | | | |
|---|---|---|---|---|
| CN | 101023312 | A | 8/2007 | |
| CN | 201917269 | U | 8/2011 | |
| CN | 102317749 | A | 1/2012 | |
| DE | WO 2010017815 | A1 * | 2/2010 | F24D 19/1009 |
| JP | 7-107563 | A | 4/1995 | |
| JP | 2000-186876 | A | 7/2000 | |
| JP | 2003-132476 | A | 5/2003 | |
| JP | 2008-501946 | A | 1/2008 | |
| JP | 2009-100276 | A | 5/2009 | |
| WO | WO 02/70976 | A1 | 9/2002 | |
| WO | WO 03/071167 | A2 | 8/2003 | |
| WO | 2005/054758 | A1 | 6/2005 | |
| WO | 2005/11917 | A | 12/2005 | |
| WO | WO 2005/119197 | A1 | 12/2005 | |
| WO | 2006/027368 | A1 | 3/2006 | |

OTHER PUBLICATIONS

Communication pursuant to Rule 71(3) dated Apr. 23, 2014 by the European Patent Office in counterpart European Application No. 12 164 949.5 (26 PGS).
International Search Report (PCT/ISA/210) dated Jun. 28, 2013, by the European Patent Office as the International Searching Authority for International Application No. PCT/EP2013/054904.
English Translation of the Notification to Grant Patent Right for Invention issued on Jun. 16, 2016, by the State Intellectual Property Office of the People's Republic of China in corresponding Chinese Patent Application No. 201380020871.3. (2 pages).
English language translation of Chinese Office Action dated Oct. 13, 2015, by the China Patent Office, in corresponding Chinese Patent Application No. 201380020871.3 (4 pages).
English language translation of Japanese Office Action dated Oct. 5, 2015, by the Japan Patent Office, in corresponding Japanese Patent Application No. 2015-506135 (5 pages).

* cited by examiner

HEAT EXCHANGER PLATE AND A PLATE HEAT EXCHANGER

TECHNICAL FIELD OF THE INVENTION

The present invention refers to a heat exchanger plate. The invention also refers to a plate heat exchanger. Such a heat exchanger plate and such a plate heat exchanger are disclosed in WO 2005/119197

BACKGROUND OF THE INVENTION AND PRIOR ART

There might be a desire to install different kinds of functional devices, such as sensors, probes, electronic devices, etc. on a large number of heat exchanger plates of the plate heat exchanger. Examples of functional devices could be for temperature measurement, pressure measurement, sending of any kind of pulses or signals and wide range of other applications.

WO 2005/119197 discloses a plate heat exchanger having a plurality of heat exchanger plates. Functional devices in the form of sensors are provided at respective plates in the proximity of a gasket for sealing the plate interspace between two adjacent heat exchanger plates. The sensors are provided for permitting monitoring of the compression of the gasket material.

SUMMARY OF THE INVENTION

A problem in connection with such or similar plate heat exchangers is that the plate heat exchanger frequently comprises a very large number of heat exchanger plates, in certain applications, up to and even more than 700 plates. If several or all plates are to be equipped with such a functional device the connection of those can be awkward. It is difficult to find appropriate positions and sufficient space for the installation of ordinary connection cables for all signals. Thus, the mounting work will be highly time-consuming.

Furthermore, in many applications, the plate heat exchangers, with such devices and connection cables, may be exposed to aggressive cleaning, possibly at high pressures, which can lead to failures of the devices. The high amount of connections puts high demands of fuzz free electric contacts.

One object of the present invention is to remedy the problems discussed above and to enable a reliable plate heat exchanger and the manufacturing of such a plate heat exchanger having a large number of heat exchanger plates with a functional device on a large number of or even all heat exchanger plates.

This object is achieved by means of the heat exchanger plate initially defined, which is characterised in that the heat exchanger plate comprises a communication module provided on the heat exchanger plate, that the communication module comprises an electronic circuit connected to the functional device and a module antenna, and that the communication module is configured to permit wireless communication of said signal with a master unit via the module antenna.

Such a communication module enables a reliable communication of the signal to or from the master unit by means of a suitable communication protocol. Since no physical connection cables are required the heat exchanger plate may be manufactured in an easy manner. The mounting of the plate heat exchanger, having a large number of heat exchanger plates each with a functional device, is facilitated.

The freedom to position the communication module is high, since it does not have to be accessible for connection cables. The communication module may thus be positioned at a place which offer proper protection to the communication module, for instance against the media flowing through the plate heat exchanger, external cleaning liquids, water, chemicals, etc.

Advantageously, the electronic circuit comprises or consists of an integrated circuit, or monolithic integrated circuit. The electronic device, and possibly the mobile antenna, may be comprised by a RFID device, i.e. a Radio Frequency Identification device, especially a ARFID device, i.e. an Active Radio Frequency IDentifcation device, having or cooperating with an electric energy source and being configured to process the signal and communicate the processed signal from or to the functional device.

According to an embodiment of the invention, the communication module comprises a visual indicator communicating with the electronic circuit and configured to indicate a state to a user. The visual indicator may be configured to indicate for instance an alarm state to the user. The visual indicator may comprise a LED.

According to a further embodiment of the invention, the communication module comprises a capacitor communicating with the module antenna and configured to permit harvesting of electric energy via the module antenna for the operation of the communication module and the device. The capacitor may comprise a capacitor receiving and storing electric energy from the electric energy source comprising a master antenna of the master unit via the mobile antenna through induction. The electric energy source of the master unit may be formed by the electricity supply network to which the master unit may be connected. The electric energy source may also be formed by a battery, a solar cell, light sensitive elements, Peltier elements, etc.

According to a further embodiment of the invention, the communication module comprises a casing enclosing at least the electronic circuit and the module antenna. Preferably, the electronic circuit and the antenna are embedded in the casing forming a tight enclosure around the electronic circuit and the antenna. The casing may be formed of a polymer material. The visual indicator may be provided to project from the casing, or may be enclosed or embedded in the casing then preferably being of a transparent or semi-transparent material.

According to a further embodiment of the invention, the functional device extends from the communication module to a position at the heat transfer area. The functional device may comprise a line extending from the communication module to the position at the heat transfer area, especially in a first plate interspace for a first medium or a second plate interspace for a second medium.

According to a further embodiment of the invention, the functional device comprises a sensor configured to sense at least one parameter and to produce said signal depending on the parameter. Such a sensor may comprise at least one of a pressure sensor, a temperature sensor, a moisture sensor etc.

According to a further embodiment, the functional device comprises a voltage generator configured to generate a voltage applied to the heat exchanger plate. Such a voltage generator may be provided for generating a voltage impulse, to be captured or sensed by a sensor for measuring various parameters, such as the viscosity of the medium, or a voltage to the heat exchanger plate in order to avoid, reduce or even remove fouling of the plate.

According to a further embodiment of the invention, the communication module is provided in the edge area. In the edge area, the communication module is properly protected from the media flowing in the plate interspaces of the plate heat exchanger. At such a location the visual indicator may be easily visible by the operator. The communication module may also in this position be accessible from outside.

According to a further embodiment of the invention, the heat exchanger plate comprises a gasket area extending around the heat transfer area inside the edge area, and provided to receive a gasket, and a number of portholes extending through the heat exchanger plate inside the gasket area. Advantageously, the communication module is positioned outside the gasket area. The functional device may extend through the gasket area.

The object is also achieved by means of the plate heat exchanger initially defined, which comprise a plurality of heat exchanger plates being arranged beside each other to define several first plate interspaces for a first medium and several second plate interspaces for a second medium, wherein at least one or some of the heat exchanger plates is a heat exchanger plate according to any one of the preceding claims. In such a plate heat exchanger, the master unit will be able to communicate with each individual heat exchanger plate by means of a suitable communication protocol. Advantageously, the master unit may be provided on the plate heat exchanger. The master unit may also comprise further communication means for communication with a further system, such as an overall control and/or monitoring system, via suitable cables or in a wireless mode.

According to a further embodiment of the invention, the master unit comprises a master antenna configured to permit said wireless communication with the communication modules via the respective module antenna.

According to a further embodiment of the invention, the master unit is configured to transfer electric energy from the master antenna to the communication modules via the respective module antenna, in order to permit each communication module to harvest electric energy from the master unit via the module antenna for the operation of the communication module and the device.

According to a further embodiment of the invention, the master antenna is provided on the plate heat exchanger and extends along a plane being transversal to the heat exchanger plates, or to the extension planes of the heat exchanger plates.

Advantageously, the master antenna may extend along a loop or be formed by a coil.

According to a further embodiment of the invention, the master unit comprises a display for displaying information to a user.

According to a further embodiment of the invention, each communication module is allotted a unique address by the master unit. Since each communication module, and thus each heat exchanger plate, has a unique address, the master unit will know from or to which heat exchanger plate the signal is communicated.

BRIEF DESCRIPTION OF THE DRAWINGS

The present invention will now be explained more closely by means of a description of various embodiments and with reference to the drawings attached hereto.

DETAILED DESCRIPTION OF VARIOUS EMBODIMENTS OF THE INVENTION

Figure 1:
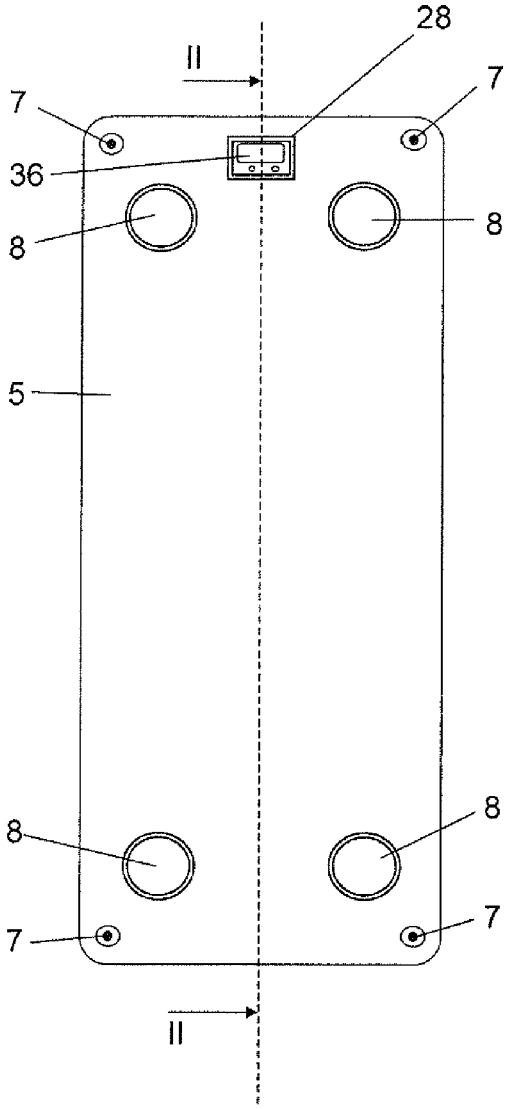
FIG. 1 discloses a front view of a plate heat exchanger comprising a plurality of heat exchanger plates according to a first embodiment of the invention.
Figure 2:
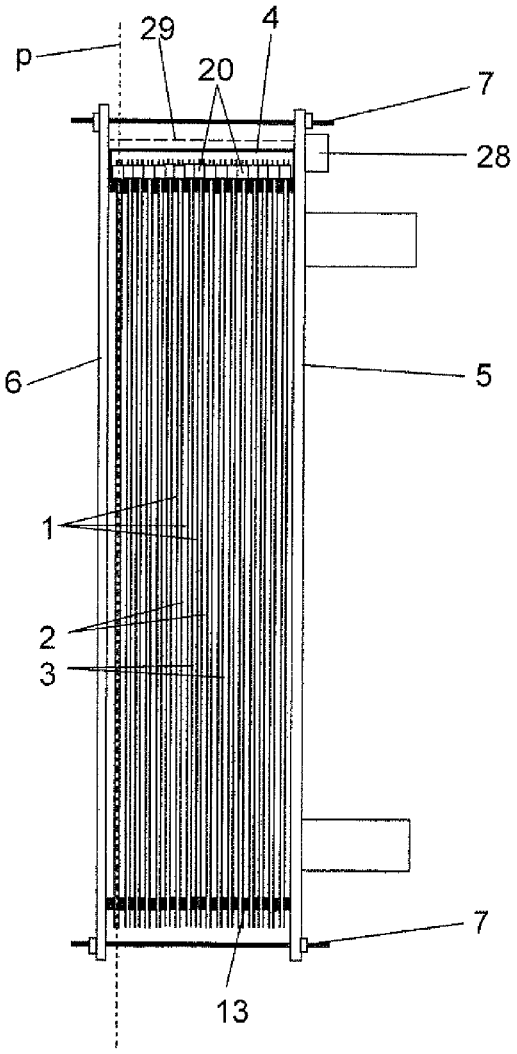
FIG. 2 discloses a side view of the plate heat exchanger along the line II-II in FIG. 1.

FIGS. 1 and 2 show a plate heat exchanger comprising a plurality of heat exchanger plates 1 forming a plate package. Each heat exchange plate 1 extends along a respective extension plane p. The heat exchanger plates 1 are arranged beside each other to define several first plate interspaces 2 for a first medium and several second plate interspaces 3 for a second medium. The first plate interspaces 2 and the second plate interspaces 3 are arranged in an alternating order in the plate package.

The heat exchanger plates 1 of the plate package are suspended on a mounting beam 4, which extends perpendicular to the extension planes p of the heat exchanger plates 1.

The heat exchanger plates 1 are pressed against each other between a frame plate 5 and a pressure plate 6 by means of tie bolts 7. In the embodiments disclosed, the plate heat exchanger comprises four porthole channels 8 forming an inlet and an outlet for the first medium and an inlet and an outlet for the second medium.

Figure 3:
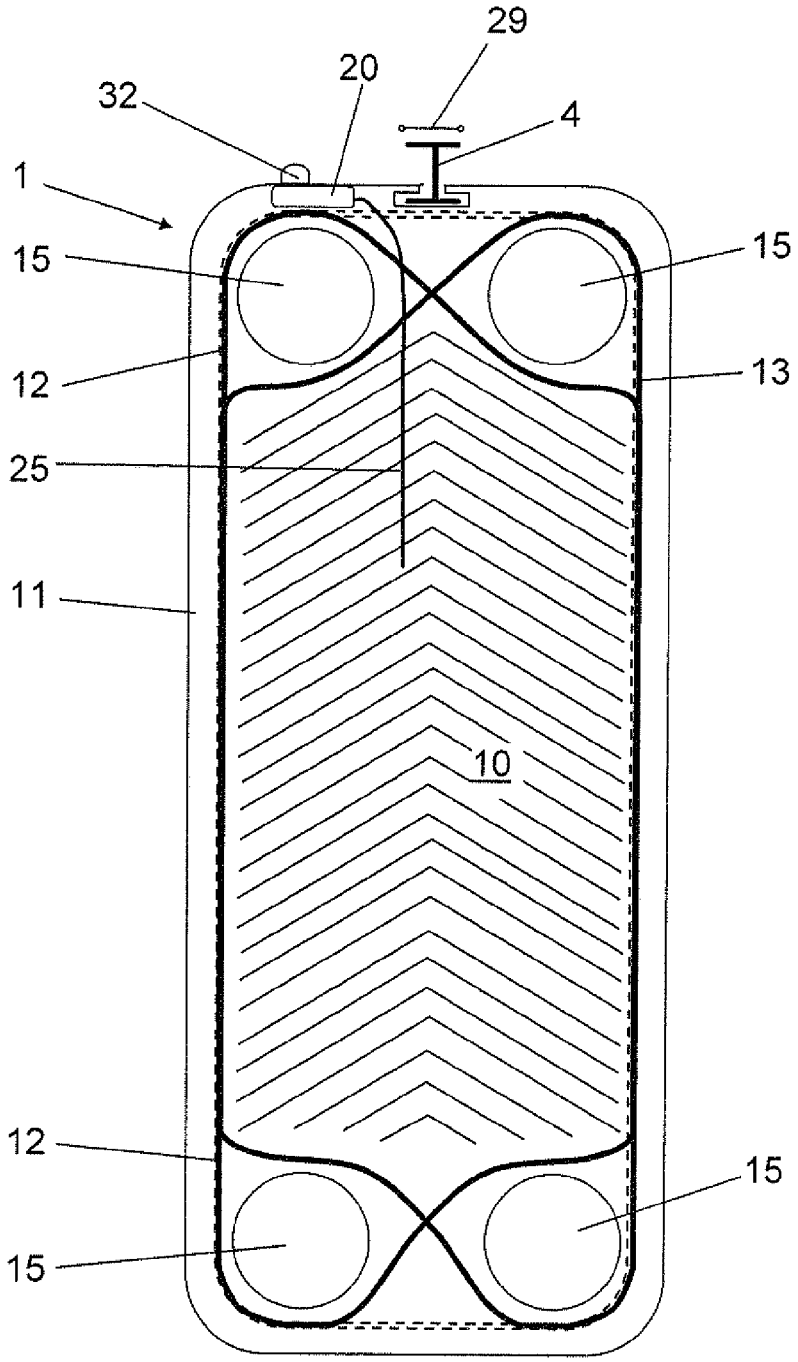
FIG. 3 discloses a front view of a heat exchanger plate of the plate heat exchanger in FIG. 1.

One of the heat exchanger plates 1 of the plate heat exchanger is disclosed in FIG. 3. The heat exchanger plate 1 comprises a heat transfer area 10 and an edge area 11, which extends around and outside the heat transfer area 10. The edge area 11 comprises the outer surrounding edge of the heat exchanger plate 1. The heat transfer area 10 may comprise a corrugation of ridges and valleys, arranged in a suitable pattern, e.g. a so called fish-bone pattern.

The heat exchanger plate 1 also comprises a gasket area 12, which extends around the heat transfer area 10 between the heat transfer area 10 and the edge area 11. A gasket 13 is provided on the gasket area 12 and extends around and encloses the heat transfer area 10. The gasket area 12 may comprise or be formed as a groove receiving the gasket 13.

In the embodiments disclosed, four portholes 15 are provided and extend through the heat exchanger plate 1. The portholes 15 are located inside and in the proximity of the gasket area 12. The portholes 15 are aligned with the porthole channels 8.

In the embodiments disclosed, the plate heat exchanger is thus mounted and held together by means of the tie bolts 7 and the gasket 13. It is to be noted, however, that the invention is applicable also to plate heat exchangers of other kinds. The heat exchanger plates 1 may for instance be permanently connected to each other by means of welding, such as laser welding or electron beam welding, gluing or even brazing. An example of an alternative mounting of the heat exchanger plates 1, is a so called semi-welded plate heat exchanger where the heat exchanger plates are welded to each other in pairs, whereby the pairs of heat exchanger plates may be pressed against each other by means of tie bolts with gasket provided between the plates.

Each, or at least one or some of the heat exchanger plates 1 of the plate heat exchanger comprises a communication module 20. In the embodiments disclosed, the communication module 20 is provided in the edge area 11, see FIG. 3. In the edge area 11, the communication module 20 is properly protected from the media flowing in the plate interspaces 2, 3 of the plate heat exchanger. Furthermore, the communication module 20 is in this position easily accessible from outside, as can be seen in FIG. 3.

Figure 4:
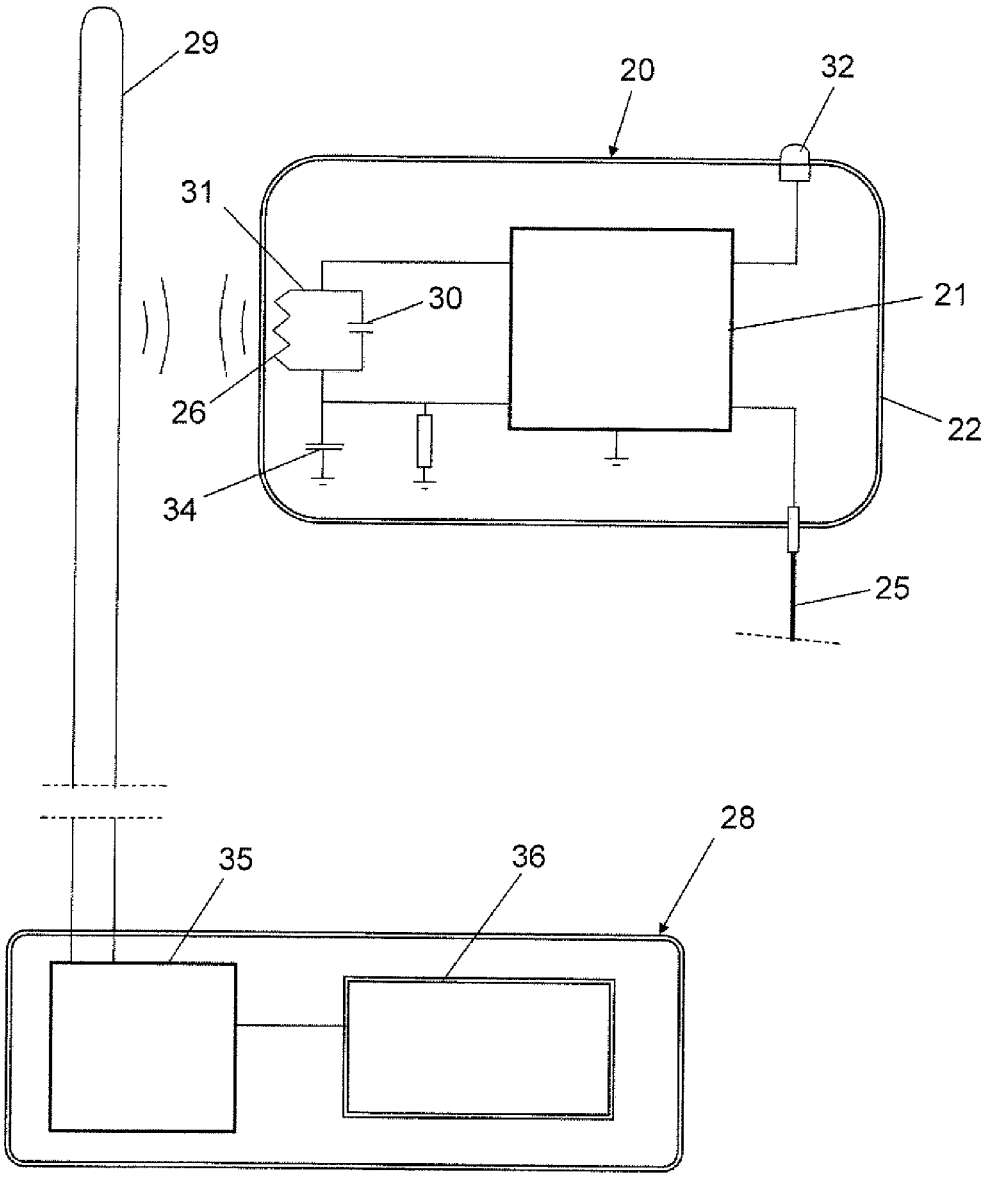
FIG. 4 discloses schematically a communication module of the heat exchanger plate in FIG. 3 and a master unit of the plate heat exchanger in FIG. 2.

The communication module 20 comprises an electronic circuit 21, see FIG. 4. The electronic circuit 21 is enclosed or embedded in a casing 22, which protects the electronic circuit 21 from being affected by external gases and liquids.

Each, or at least one or some of the heat exchanger plates 1 of the plate heat exchanger also comprises a functional device 25, which is configured to receive or produce a signal. The functional device 25 is connected to and communicates with the electronic circuit 21, see FIG. 4, so that the signal may be communicated to or from the functional device 25. The functional device 25 extends from the communication module 20 to a position where the function is to be sensed or applied, for instance at the heat transfer area 10, see FIG. 3, at the gasket area 12, such as beneath the gasket 13, or at the edge area 11.

In a first embodiment, the functional device 25 comprises or consists of a sensor for sensing a parameter, for instance a temperature sensor, a pressure sensor or a moisture sensor, and to produce a signal depending on the value of the sensed parameter. The sensor, or a sensor probe of the sensor, may be made of an electrically conducting material in the form of at least a wire, a strip, a foil or a net. The sensor, or sensor probe, may be attached to or provided on the heat exchanger plate 1, especially on the heat transfer area 10, in a region where the parameter is to be sensed. The sensor, or the sensor probe, may comprise an insulating layer which insulates the sensor, or the sensor probe, from electric contact with the heat exchanger plate 1.

The communication module 20 also comprises a module antenna 26 to permit wireless communication of the signal of the functional device 25 with a master unit 28 via a master antenna 29 of the master unit 28, see FIG. 4.

The electronic circuit 21 comprises or consists of an integrated circuit, or monolithic integrated circuit. The electronic device 21 and the mobile antenna 26 is in the embodiments disclosed comprised by a RFID device, i.e. a Radio Frequency Identification device, especially a ARFID device, i.e. an Active Radio Frequency IDentifcation device. The electronic circuit 21 may for instance comprise or consist of an integrated circuit from Texas Instruments, TMS37157.

The module antenna 26 is connected in parallel with a capacitor 30. The module antenna 26 and the capacitor 30 form a tuned oscillation circuit 31 having a resonance frequency. The module antenna 26 comprises or consists of a coil, e.g. a coil with a ferrite core.

The communication module 20 also comprises a visual indicator 32, which communicates with the electronic circuit 21 and is configured to indicate a state of the heat exchanger plate 1 to a user of the plate heat exchanger. The visual indicator 32 may be configured to indicate for instance an alarm state to the user and/or from which heat exchanger plate 1 the value of a sensed parameter emanates. The visual indicator 32 may comprise a LED, Light Emitting Diode.

Furthermore, the communication module 20 comprises a capacitor 34, which is connected to the module antenna 26, and more precisely to the oscillation circuit 31. The capacitor 34 comprises or consists of a capacitor in the embodiments disclosed. The capacitor 34 thus communicates with the module antenna 26 and is configured to permit harvesting of electric energy from the master antenna 29 of the master unit 28. The capacitor 34 thus may receive and store electric energy from an electric energy source of the master unit 28 via the master antenna 29 through induction. The electric energy source of the master unit 28 may be formed by the electricity supply network to which the master unit 28 may be connected. The electric energy source may also be formed by a battery, a solar cell, light sensitive elements, Peltier elements, etc.

The casing 22 encloses, in the embodiments disclosed, the electronic circuit 21, the module antenna 26, the capacitor 30, the capacitor 34 and the connections to the functional device 25 and the visual indicator 32. At least a part of the visual indicator 31 may project from the casing 22. Preferably, the electronic circuit 21, the module antenna 26, the capacitor 30, the capacitor 34 and the connections to the functional device 25 and the visual indicator 32 are embedded in the casing 22, which forms a tight enclosure around these components. The casing 22 may be formed of a polymer material, for instance a transparent or semitransparent material, wherein the components are moulded in the polymer material.

The master unit 28 comprises a processor 35 of any suitable kind. The master antenna 29 extends in a coil or a loop, e.g. along the mounting beam 4, and is connected to the processor 35. In the embodiment disclosed the master unit 26 is mounted to the plate heat exchanger, for instance on the frame plate 5 as indicated in FIGS. 1 and 2. The master unit 28 may comprise a display 36 for displaying information to a user, or may be connected to a computer. The master unit 28 may also comprise means (not disclosed) for communication with other systems, such as an overall control or monitoring system.

Signals from each of the functional devices 25 may thus be communicated to the master unit 28 via the respective communication module 20. The master unit 28 is thus configured to receive and process the signals from the functional devices 25 of all the heat exchanger plates 1.

The wireless communication is performed according to a suitable communication protocol, configured to permit the wireless communication between the functional devices 25 and the master unit 28 via the respective communication modules 20. The wireless communication is initiated, monitored and controlled via or by the master unit 28. The communication of the signal, or the processed signal, may take place at a suitable frequency, e.g. 132 kHz. Furthermore, the communication may be based on amplitude switching or frequency shift.

Initially, all heat exchanger plates 1 and all communication modules 20 may be identical. Upon initialisation, each communication module 20 is then allotted a unique address by the master unit 28. Thereafter, the wireless communication may be performed with the different communication modules 20. Most of the logic signal handling and the alarm handling may be made in and by the master unit 28. This reduces the complexity and the costs for the communication modules 20, and thus for the heat exchanger plates 1. It also reduces the amount of information to be communicated. For instance, a sensor of the functional device 25 may communicate only the actual value of the parameter sensed, while the alarm limit and the identification of alarm is handled by the master unit 28. In this way it is easy to change alarm limits. Thanks to the unique address of each communication module 20, it is possible for the master unit 28 to tell the operator, for instance via the display 36, or the overall control or monitoring system, not only that an alarm has occurred, but also to indicate on which plate the alarm is created by means of the visual indicator 32 concerned.

According to second embodiment, the functional device 25 comprises a voltage generator configured to generate a voltage impulse, to be captured or sensed by a sensor for measuring various parameters, such as the viscosity of the medium, or a voltage, which may be applied to the heat transfer area 10 of the heat exchanger plate 1. Such a voltage may be applied in order to avoid or remove fouling on the heat exchanger plates 1, especially in the heat transfer area 10. In the second embodiment, the voltage may be taken from the capacitor 34 upon a command signal from the master unit 28.

In a third embodiment, the heat exchanger plates 1 are double wall plates formed by two adjoining plates compressed to be in contact with each other. With such a double wall plate, the functional device 25, for instance in the form of a sensor of the above mentioned kind, may be provided between the adjoining plates of the heat exchanger plate 1. In the third embodiment, the sensor may be configured to sense leakage, i.e. a break in one of the plates, which results in humidity between the plates of the heat exchanger plate 1. This humidity may be sensed by the sensor, for instance through sensing of the capacitance between the sensor and the heat exchanger plate. The voltage for the capacitance sensing may be provided by the capacitor 34.

The present invention is not limited to the embodiments disclosed but may be varied and modified within the scope of the following claims.

The invention claimed is:

1. A plate heat exchanger comprising a plurality of heat exchanger plates and configured to include first plate interspaces for a first medium between first adjacent ones of the heat exchanger plates and second plate interspaces for a second medium between second adjacent ones of the heat exchanger plates, each of the first plate interspaces having an extent bounded by an outer periphery of the first plate interspace, and each of the second plate interspaces having an extent bounded by an outer periphery of the second plate interspace, at least some of the plurality of heat exchanger plates each comprising:

a heat transfer area;

an edge area extending around and outside the heat transfer area;

a functional device configured to receive or produce a signal;

a communication module provided on the at least one of the heat exchanger plates in the edge area;

the communication module comprising an electronic circuit connected to the functional device and a module antenna;

the communication module being configured to permit wireless communication of said signal with a master unit via the module antenna; and the functional device comprising a line extending from the communication module, along at least a portion of the extent of one of the first and second plate interspaces, to a position at the heat transfer area of the at least one of heat exchanger plates.

2. A plate heat exchanger according to claim 1, wherein the communication module comprises a visual indicator communicating with the electronic circuit and configured to indicate a state to a user.

3. A plate heat exchanger according to claim 2, wherein the visual indicator comprises an LED.

4. A plate heat exchanger according to claim 1, wherein the communication module comprises a capacitor communicating with the module antenna and configured to permit harvesting of electric energy via the module antenna for the operation of the communication module and the functional device.

5. A plate heat exchanger according to claim 1, wherein the communication module comprises a casing enclosing at least the electronic circuit and the module antenna.

6. A plate heat exchanger according to claim 1, wherein the functional device comprises a sensor configured to sense at least one parameter and to produce said signal depending on the parameter.

7. A plate heat exchanger according to claim 1, wherein the functional device comprises a voltage generator configured to generate a voltage applied to the at least some of the heat exchanger plates.

8. A plate heat exchanger according to claim 1, wherein the at least some of the heat exchanger plates comprises:

a gasket area extending around the heat transfer area inside the edge area, and provided to receive a gasket; and a number of portholes extending through the at least some of the heat exchanger plates inside the gasket area.

9. A plate heat exchanger according to claim 1, wherein the master unit comprises a master antenna configured to permit said wireless communication with the communication module of each of the at least some of the heat exchanger plates via the respective module antenna of the each of the at least some of the heat exchanger plates.

10. A plate heat exchanger according to claim 9, wherein the master unit is configured to transfer electric energy from the master antenna to the communication module of each of the at least some of the heat exchanger plates via the respective module antenna of the each of the at least some of the heat exchanger plates.

11. A plate heat exchanger according to claim 9, wherein the master antenna is provided on the plate heat exchanger and extends along a plane being transversal to the plurality of heat exchanger plates.

12. A plate heat exchanger according to claim 1, wherein the master unit comprises a display for displaying information to a user.

13. A plate heat exchanger according to claim 1, wherein the communication module of each of the at least some of the heat exchanger plates is allotted a unique address by the master unit.

14. A plate heat exchanger according to claim 1, wherein the functional device is one of a plurality of functional devices, and wherein all of the heat exchanger plates in the plate heat exchanger include one of the functional devices.

* * * * *